United States Patent [19]

Larson et al.

[11] Patent Number: 4,772,528

[45] **Date of Patent: * Sep. 20, 1988**

[54] LIQUID ELECTROSTATIC DEVELOPERS COMPOSED OF BLENDED RESINS

[75] Inventors: James R. Larson; Torence J. Trout, both of Wilmington, Del.

[73] Assignee: E. I. Du Pont de Nemours and Company, Wilmington, Del.

[ * ] Notice: The portion of the term of this patent subsequent to Jul. 21, 2004 has been disclaimed.

[21] Appl. No.: 46,539

[22] Filed: May 6, 1987

[51] Int. Cl.[4] ..... G03G 9/12

[52] U.S. Cl. ..... 430/115; 430/114

[58] Field of Search ..... 430/114, 115

[56] References Cited

U.S. PATENT DOCUMENTS

| | | | |
|---|---|---|---|
| 3,788,995 | 1/1974 | Stahly et al. | 430/114 |
| 3,849,165 | 11/1974 | Stahly et al. | 430/114 |
| 4,081,391 | 3/1978 | Tsubuko et al. | 430/115 |
| 4,170,563 | 10/1979 | Merrill et al. | 430/115 |
| 4,171,275 | 10/1979 | Merrill et al. | 430/115 |
| 4,202,785 | 5/1980 | Merrill et al. | 430/106 |
| 4,229,513 | 10/1980 | Merrill et al. | 430/115 |
| 4,663,264 | 5/1987 | Mitchell | 430/115 |
| 4,681,831 | 7/1987 | Larson et al. | 430/114 |
| 4,702,984 | 10/1987 | El-Sayed et al. | 430/115 |
| 4,707,429 | 11/1987 | Trout | 430/115 |

*Primary Examiner*—Roland E. Martin

[57] ABSTRACT

A liquid electrostatic developer containing negatively chargeable resin particles with improved charging characteristics, said developer consisting essentially of (A) nonpolar liquid having a Kauri-butanol value of less than 30, present in a major amount;

(B) resin particles of a blend of at least two polymers, at least one polymer containing at least one acidic constituent having a pKa of less than 4.5 measured at 25° C. in water, and the blend having an acid number of at least one due to said acidic constitutent; the resin particles having an average by area particle size of less than 10 μm, and (C) nonpolar liquid soluble ionic or zwitterionic charge director compound.

A preferred polymer blend is composed of polystyrene and a sulfonated polymer, e.g., poly(2-acrylamido-2-methyl-1-propanesulfonic acid). The average resin particle size by area is less than 10 μm. Optionally a colorant and other additives or adjuvants are present. The liquid electrostatic developer is useful in copying making proofs including digital color proofs, lithographic printing plates, and resists.

20 Claims, No Drawings

LIQUID ELECTROSTATIC DEVELOPERS COMPOSED OF BLENDED RESINS

TECHNICAL FIELD

This invention relates to liquid electrostatic developers having improved image quality. More particularly this invention relates to a liquid electrostatic developer containing as a constituent a negatively chargeable resin blend.

BACKGROUND ART

It is known that a latent electrostatic image can be developed with toner particles dispersed in an insulating nonpolar liquid Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed. it has been found desirable to add a charge director compound to the liquid toner comprising the thermoplastic resin, dispersant nonpolar liquid and generally a colorant. Such liquid developers provide images of good resolution, but it has been found that the charging and image quality are particularly pigment dependent. For example, liquid electrostatic developers wherein copolymers of ethylene and carboxylic acid containing monomers are used to form the resin particles proVide good image quality particularly when carbon black pigments are present in the formulation. Removal of the pigment, however, normally results in poor charging and resultant poor images. Charging and image quality of such developers can be improved independent of pigment by the use of strongly acidic resins. In Larson and Trout, U.S. Ser. No. 880,155, filed June 30, 1986, resin particles in a liquid electrostatic developer are disclosed wherein a constituent containing at least one acidic constituent having a pKa of less than 4.5 measured at 25° C. in water can be present as part of a homopolymer or copolymer. The preparation of such resins require skilled chemists and the procedures are time consuming and expensive. In addition, some of these resins may require special care in processing liquid electrostatic deVelopers prepared using them.

It has been found that the above disadvantages can be overcome and liquid electrostatic developers prepared containing a resin blend ionic or zwitterionic compound soluble in nonpolar liquid which have excellent negative charging characteristics, good image quality, with excellent resolution, evenness of toning, solid area coverage, and toning of fine details independent of pigment.

DISCLOSURE OF THE INVENTION

In accordance with this invention there is provided a liquid electrostatic developer containinq neqatively chargeable resin particles with improved charging characteristics, said developer consisting essentially of (A) nonpolar liquid having a Kauri-butanol value of less than 30, present in a major amount;

(B) resin particles of a blend of at least two polymers, at least one polymer containing at least one acidic constituent having a pKa of less than 4.5 measured at 25° C. in water, and the blend having an acid number of at least one due to said acidic constituent; the resin particles having an average by area particle size of less than 10 μm, and (C) nonpolar liquid soluble ionic or zwitterionic charge director compound.

Throughout the specification the below-listed terms have the following meanings:

In the claims appended hereto "consisting essentially of" means the composition of the liquid electrostatic developer does not exclude unspecified components which do not prevent the advantages of the developer from being realized. For example, in addition to the primary components, there can be present additional components, such as a colorant, adjuvant e.g., polyhydroxy compound aminoalcohol, polybutylene succinimide aromatic hydrocarbon, metallic soap, inorganic metal salt, etc.

Aminoalcohol means that there is both an amino functionality and hydroxy functionality in one compound.

Acid number is the milligrams of potassium hydroxide required to neutralize 1 gram of polymer.

Conductivity is the conductivity of the developer measured in picomhos (pmho)/cm at 5 hertz and 5 volts and can be referred to as bulk conductivity.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C. and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28 determined by ASTM D 1133. The ratio of the blend of thermoplastic resins or polymers to dispersant nonpolar liquid is such that the combination of ingredients becomes fluid at the working temperature.

The resin particles (B) of the liquid electrostatic developer are blends of at least one polymer containing at least one acidic constituent having a pKa of less than 4.5, preferably a pKa of less than 3.0, measured at 25° C. in water, and at least one other polymer described more fully below. The blend has an acid number of at least one due to said acidic constituent(s).

One polymer component in the blend of at least two polymers useful to form the resin particles has at least one acidic constituent having a pKa of less than 4.5 measured in water and an acid number due to said acidic constituent of at least one. Examples of such polymers include: a partial ester of 3-hydroxypropanesulfonic acid and copolymer of ethylene and $\alpha,\beta$ ethylenically unsaturated acid, e.g., acrylic acid, methacrylic acid having an acid number of at least one based on 3-hydroxypropanesulfonic acid: sulfonated polystyrene, sulfonated polyethylene, homopolymers of the following monomers:

vinyl sulfonic acid,
styrene sulfonic acid,
2-acrylamido-2-methyl-1-propane sulfonic acid,
1-chloroacrylic acid,
1-trifluoromethacrylic acid,
sulfoethylacrylate,
sulfopropylacrylate,
sulfobutylacrylate,
sulfoethylmethacrylate,
sulfopropylmethacrylate,
sulfobutylmethacrylate,
ethyl hydrogen p-vinyl benzyl phosphonate,
vinyl phosphonic acid; polymers containing more than one monomer where at least one monomer is strongly acidic such as those listed above and the following monomer(s) or mixtures thereof: ethylene, propylene, butylene, isobutylene, acrylate with a side chain of 2 to 30 carbon atoms, styrene, vinyltoluene, 4-octyl styrene, vinylnaphthalene, acrylamides with side chains of 2 to 30 carbon atoms. butadiene, isoprene, methylacrylate, methylmethacrylate, vinylalcohol, vinylmethylketone, vinylacetate, vinylpropionate, vinylbenzoate, vinylstyrene, acrylic acid, methacrylic acid, chlorinated ethylene, fluoronated ethylene, vinylbromide, acryonitrile, chlorostyrene, etc. Larson and Trout. U.S. Ser. No. 880,155, filed June 30, 1986, page 5, line 21 to page 7, line 24, illustrate certain procedures for preparing some of the above polymers, the disclosure of which is incorporated herein by reference.

At least one other polymer is present in the polymer blend. Suitable polymers include: ethylene vinyl acetate (EVA) copolymers (Elvax ® resins E. I. du Pont de Nemours and Company, Wilmington, Del.), copolymers of ethylene and an $\alpha,\beta$-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford. Conn.; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, Del., etc., or blends thereof. Preferred copolymers are the copolymer of ethylene and an $\alpha,\beta$-ethylenically unsaturated acld of elther acrylic acid or methacrylic acid. The synthesis of copolymers of this type are described in Rees U.S. Pat. No. 3,264,272, the disclosure of which is incorporated herein by reference For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. The melt index (g/10 min) of lo to 500 is determined by ASTM D 1238 procedure A. Particularly preferred copolymers of this type have an acid number of 66 and 60 and a melt index of 100 and 500 determined at 190° C. respectively.

The resin blend has the following characteristics:

1. Be able to disperse any colorant, e.g., pigment, metal soap metal salt etc. that may be present
2. Be substantially insoluble in the dispersant (nonpolar) liquid (A) at temperatures below 4° C, so that the resin blend will not dissolve or solvate in storage.
3. Be able to solvate at temperatures above 50° C. whereas an individual resin of the blend may not,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer manufactured by Horiba Instruments Inc., Irvine Calif.: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.
6. Be able to fuse at temperatures in excess of 70° C.
7. Be able to remain substantially homogeneous at least during blending, developer preparation and imaging.
8. Acid number of at least one due to said acidic constituent having a pKa of less than 4.5 measured in water (whereby the polymer composition of the polymer blend can be determined).

By solvation in 3. above, the resin blend forming the toner particles will become swollen or gelatinous. The polymer blend is prepared by mixing the two or more polymers as described above together, in a suitable mixing apparatus such as two roll twin screw extruder. attritor, Ross double planetary mixer, or other apparatus known to those skilled in the art at an elevated temperature, e.g., in the range of 60° to 200° C., preferably 80° to 180° C. for a sufficient mixing time. The temperature must not exceed the degradation temperature of any one component.

Components (A) and (B) are present in the liquid electrostatic developer in the following amounts:

Component (A): 85.0 to 99.9% by weight, preferably 97.0 to 99.5% by weight; and

Component (B): 0.1 to 15.0% by weight, preferably 0.5 to 3.0% by weight, based on the total weight of the developer.

Suitable nonpolar liquid soluble ionic or zwitterionic charge director compounds (C), which are generally used in an amount of 1 to 1000 mg/g, preferably 1 to 250 mg/g developer solids, include: negative charge directors, e.g., lecithin, Ninate 411 ® dodecylbenzenesulfonate, Basic Calcium petronate ®, Basic Barium petronate ®, Neutral Barium petronate ® oil-soluble petroleum sulfonate, manufactured by Sonneborn Division of Witco Chemical Corp.. New York. N.Y., alkyl succinimide (manufactured by Chevron Chemical Company of California), etc.

As indicated above, an additional component that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids (qenerally resin blend unless other solids are present), preferably 0.01 to 30% by weight based on the total weight of developer solids. The amount of colorant may vary depending on the use of the developer. Examples of pigments are Monastral ® Blue G (C.I. Pigment Blue 15 C.I. No. 74160), Toluidine Red Y (C.I. Pigment Red 3). Quindo ® Magenta (Pigment Red 122), Indo ® Brilliant Scarlet (Pigment Red 123, C.I. No. 71145), Toluidine Red B (C.I. Pigment Red 3), Watchung ® Red B (C.I. Pigment Red 48). Permanent Rubine F6B13-1731 (Pigment Red 184), Hansa ® Yellow (Pigment Yellow 98), Dalamar ® Yellow (Pigment Yellow 74, C.I. No. 11741), Toluidine Yellow G (C.I. Pigment Yellow 1), Monastral ® Blue B (C.I. Pigment Blue 15), Monastral ® Green B (C.I. Pigment Green 7), Pigment Scarlet (C.I. Pigment Red 60), Auric Brown (C.I. Pigment Brown 6), Monastral ® Green G (Pigment Green 7), Carbon Black, Cabot Mogul L (black Pigment C.I. No. 77266) and Stirling NS N 774 (Pigment Black 7, C.I. No. 77266).

It is known that fine particle size oxides, e.g., silica, alumina, titania, etc.; preferably in the order of 0.5 μm or less can be dispersed into the liquefied resin blend used in liquid electrostatic developers. The presence of such oxide particles is not necessary to aid the charging of the developers.

Another additional component of the electrostatic liquid developer is an adjuvant which can be taken from the group of polyhydroxy compound which contains at least 2 hydroxy groups, aminoalcohol, polybutylene succinimide, metallic soap, inorganic metal salt, and aromatic hydrocarbon having a Kauri-butanol value of greater than 30, and metallic soap. The adjuvants, other than metallic soap, are generally used in an amount of 1 to 1000 mg/g, preferably 1 to 200 mg/g developer solids. The metallic soap, when present, is useful in an amount of 0.01 to 60 percent by weight based on the total weight of the developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon and the remainder oil, etc.

metallic soao: aluminum tristearate, aluminum distearate, barium, calcium, lead and zinc stearates; cobalt, manganese, lead and zinc linoleates; aluminum, calcium and cobalt octoates, calcium and cobalt oleates, zinc palmitate. calcium, cobalt, manganese. lead and zinc naphthenates, calcium, cobalt, manganese, lead and zinc resinates, etc. The metallic soap is dispersed as described in Trout U.S. application Ser. No. 857.326, filed Apr. 30, 1986, in the resin blend.

inorqanic metal salts: salts wherein the cationic component is selected from the group consisting of metals of Group Ia, Group IIa, and Group IIIa of the periodic table, and wherein the anionic component of said salt is selected from the group consisting of halogen, carbonate, acetate, sulfate, borate, nitrate and phosphate. The inorganic metal salt is dispersed as described in El-Sayed U.S. application Ser. No. filed Feb. 12, 1987, entitled "lnorganic Metal Salt as Adjuvant For Negative Liquid Electrostatic Developers," in the resin blend.

aromatic hydrocarbonL benzene, toluene, naphthalene, substituted benzene and naphthaline compounds, e.g., Irimethylbenzene, zylene, dimethylethylbenzene, ethylmethylbenzene, propylbenzene, Aromatic 100 which is a mixture of $C_9$ and $C_{10}$ alkyl-substituted benzenes manufactured by Exxon Corp., etc.

The particles in the electrostatic liquid developer have an average by area particle size of less than 10 μm, preferably the average by area particle size is less than 5 μm. The resin blend particles of the developer may or may not be formed having a plurality of fibers integrally extending therefrom. The term "fibers" as used herein means toner particles formed with fibers tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding Ross double planetary mixer manufactured by Charles Ross and Son, Hauppauge, N.Y., etc., or a two roll heated mill (no particulate media necessary) are placed the resin blend, and dispersant nonpolar liquid described aboVe. Generally the resin blend, dispersant nonpolar liquid and optional colorant are placed in the vessel prior to starting the dispersing step. Optionally the colorant can be added after homogenizing the resin blend and the dispersant nonpolar liquid. Polar additive can also be present in the vessel e.g., up to 100% based on the weight of polar additive and dispersant nonpolar liquid. The dispersing step is generally accomplished at elevated temperature, i.e., the temperature of ingredients in the vessel being sufficient to plasticize and liquefy the resin blend but being below that at which the dispersant nonpolar liquid or polar additive if present degrades and the resin and/or colorant decomposes. A preferred temperature range is 80° to 180° C. Other temperatures outside this range may be suitable, however, depending on the particular ingredients used. The presence of the irregularly moving particulate media in the vessel is preferred to prepare the dispersion of toner particles. Other stirring means can be used as well however, to prepare dispersed toner particles of proper size, configuration and morphology. Useful particulate media are particulate materials, e.g., spherical, cylindrical, etc. taken from the group consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to 13 mm).

After dispersing the ingredients in the vessel, with or without a polar additive present until the desired dispersion is achieved typically 1 to 2 hours with the mixture being fluid, the dispersion is cooled, e.g., in the range of 0° C. to 50° C. Cooling may be accomplished, for example, in the same vessel, such as the attritor, while simultaneously grinding in the presence of additional liguid with particulate media to prevent the formation of a gel or solid mass; without stirring to form a gel or solid mass, followed by shredding the gel or solid mass and grinding e.g., by means of particulate media in the presence of additional liquid; or with stirring to form a viscous mixture and grinding by means of particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin blend precipitates out of the dispersant or solidifies during the cooling. Toner particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present by means known to those skilled in the art, it is possible to reduce the concentration of the toner particles in the dispersion, impart an electrostatic charge to the toner particles or a combination of these variations. The concentration of the toner particles in the dispersion is reduced by the addition of additional dispersant nonpolar liquid as described previously above. The dilution is normally conducted to reduce the concentration of toner particles to between 0.1 to 15 percent by weight, preferably 0.3 to 3.0, and more preferably 0.5 to 2 weight percent with respect to the dispersant nonpolar liquid. One or more nonpolar liquid soluble ionic or zwitterionic charge director compounds (C), of the type set out above, can be added to impart a negative charge. The addition may occur at any time during the process; preferably at the end of the process, e.g., after the particulate media, if used, are removed and the concentration of toner particles is accomplished. If a diluting dispersant nonpolar liquid is also added, the charge director compound can be added prior to, concurrently with or subsequent thereto. If an adjuvant compound of a type described above has not been previously added in the preparation of the developer, it can be added prior to or subsequent to the developer being charged. Preferably the adjuvant compound is added after the dispersing step. A preferred mode of the invention is described in Example 4.

INDUSTRIAL APPLICABILITY

The negative liquid electrostatic developers of this invention demonstrate improved image quality, solid area coverage (density), resolution and toning of fine details, and evenness of toning independent of charge director and pigment present. The particles are exclusively charged negative. The developers of this invention are useful in copying, e.g., making office copies of black and white as well as various colors; or color proofing e.g., a reproduction of an image using the standard colors: yellow, cyan, magenta together with black as desired. In copying and proofing the toner particles are applied to a latent electrostatic image and can be transferred, if desired. Other uses are envisioned for the liquid electrostatic developers include: digital color proofing lithographic printing plates. and resists.

EXAMPLES

The following controls and examples wherein the parts and percentages are by weight illustrate but do not limit the invention. The melt indices were determined by ASTM D 1238, Procedure A; the average particle sizes by area were determined by a Horiba CAPA-500 centrifugal particle analyzer as described above, bulk conductivities were measured in picomhos (pmho/cm) at five hertz and low voltage 5.0 volts, the densities were measured using a Macbeth densitometer model RD918, transfer efficiencies are determined as follows: a toned electrostatic image is transferred from the photoreceptor in the copier to a paper carrier sheet. A transparent adhesive tape is applied over the residual toned electrostatic image on the photoreceptor and the residual image is removed with the tape and placed on the previously image carrier sheet adjacent to (but not contacting) the transferred image. The density of both images is measured with a densitometer as previously described. The transfer efficiency is the percentage value obtained by dividing the density of the transferred image by the sum of the densities of the transferred and residual images using plainwell offset enamel paper number 3 class 60 lbs. test. Resolution is expressed in line pairs/mm (lp/mm).

CONTROL 1

In a Union process ls Attritor, Union Process Company, Akron, Ohio were placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Heucophthal Blue G XBT-583D, manufactured by Heubach, Inc. Newark, NJ | 14.0 |
| Isopar ®-L, nonpolar liquid having a Kauri-butanol value of 27, Exxon Corporation | 1000.0 |

The ingredients were heated to 90° C.±10° C. and milled at a rotor speed of 230 rpm with 0.1875 inch (4.76 mm) diameter stainless steel balls for 1.5 hours. The attritor was cooled to 42° C.±5° C. while the milling was continued and then 700 grams of Isopar ®-H, nonpolar liquid having a Kauri-butanol value of 27, Exxon Corporation were added. Milling was continued for 67 hours yielding toner particles having an average particles size of 1.02 μm. The particulate media were removed and the dispersion of toner particles was then diluted to 2% solids by weight with additional Isopar ®-H and a charge director such as lecithin was added. Image quality was determined using a Savin 870 copier at standard mode: charging corona set at 6.8 kv and transfer corona set at 8.0 kv using carrier sheets such as plainwell offset enamel paper number 3 class 60 lb. test.

Charging with lecithin at an amount of 31 mg of lecithin/g of developer solids resulted in bulk conductivity of 61 pmho/cm. Results show a density of 1.27 for plainwell offset enamel, with a resolution of 4–6 lpmm, and 98% transfer efficiency. Image quality was very poor with poor resolution, unevenness of toning of fine details and copy, and uneven streaky solid area coverage. Results are in Table 1 below.

CONTROL 2

A cyan toner was prepared using the following procedure: 7.0 grams of Heucophthal Blue G XBT 583D pigment were dispersed in 100 grams of polystyrene (Ultrafine powder. #15790) from Polysciences Inc., Warrington Pa., by two roll milling at 180° C. The pigmented polymer was then chopped in a blender with liquid nitrogen. 40 grams of the chopped material. 125 grams of Isopar ®-L. nonpolar liquid having a Kauri-butanol value of 27. Exxon Corporation and 125 grams of Isopar ®-H, nonpolar liquid having a Kauri-butanol value of 27 Exxon Corporation were placed in a Union Process 01 Attritor Union Process Company, Akron, Ohio, and milled at a rotor speed of 230 rpm with 0.1875 inch (4.76 mm) diameter stainless steel balls for 121 hours until toner particles having an average particle size of 1.14 μm were obtained. The particulate media were removed and the dispersion of toner particles was then diluted to 2 percent solids by weight with additional Isopar ®-H and a charge director such as Lecithin was added at an amount of 35 mg of lecithin/g of toner solids to give a bulk conductivity of 53 pmho/cm. Image quality was determined as described in Control 1.

Results show a density of 1.90 for plainwell offset enamel with a resolution of 8–9 lp/mm. and 97% transfer efficiency. Image quality was fair with reduced resolution. unevenness of toning, and uneven solid area coverage. Results are in Table 1 below:

CONTROL 3

A cyan toner was prepared using the procedure described in Control 1 with the following exceptions: 35 grams of a copolymer of ethylene (89%) and methacrylic acid (11%), melt index at 190° C. is 100 Acid No. is 66, 2.45 grams of Ihe Heucophthal Blue G XBT 583D pigment, 0.75 g of p-toluene sulfonic acid, Fisher Scientific Co., Fairlawn, N.J. and 125 grams of Isopar ®-L were placed in a Union process 01 Attritor, Union Process Company, Akron, Ohio. The ingredients were heated to 90° C.±10° C. and milled at a rotor speed of 230 rpm with 0.1875 inch (4.76 mm) diameter stainless steel balls for 2 hours. The attritor was cooled to 42° C.+5° C. while the milling was continued and then 125 grams of 5 Isopar ®-H, nonpolar liquid having a Kauri-butanol value of 27, Exxon Corporation were added. Milling was continued for 17 hours yielding toner particles having an average particles size of 1.57 μm.

Toner was diluted to 2% solids with Isopar ®-H and charged with lecithin at an amount of 31 mg of lecithin/g of developer solids resulting in a bulk conductivity of 60 pmho/cm. Image quality was very poor with almost no image low resolution, and uneven copy. Density and transfer efficiency could not be measured. Results are in Table 1 below.

CONTROL 4

A cyan toner was prepared by adding 12.5 g of a copolymer of ethylene (89%) and methacrylic acid (11%), melt index at 190° C. is 100, Acid No. is 66, 12.5 grams of polystyrene (ultrafine powder, #15790) from Ppolysciences Inc., Warrington, Pa., 1.75 grams of Heucophthal Blue G XBT 583D pigment, and 125 grams of Isopar ®-L to a Union Process 01 Attritor. Union Process Company, Akron, Ohio charged with 0.1875 (4.76 mm) diameter carbon steel balls. The mixture was milled at 100° C. for I hour then cooled to ambient temperature and milled for 6 hours. The particle size was 1.73 μm. 1249 grams of 1.5% solids was charged with 15 grams of 5.5% Basic Barium Petronate ® giving a toner with a bulk conductivity of 33 phmos/cm. Image quality was poor with uneven solids and low density Transfer efficiency was 9%. Results are found in Table 1 below.

EXAMPLE 1

A cyan toner was prepared according to the procedure described in Control 2 with the following exceptions: 10 grams of poly(2-acrylamido-2-methyl-1-propanesulfonic acid) 10% aqueous solution (Aldrich Chemical Co., Milwaukee, Wisc.) was dispersed in 100 grams of a copolymer of ethylene (89%) and methacrylic acid (11%), melt index at 190° C. is 100, Acid No. is 66 by two roll milling at 120° C. This also removed the water. 7.1 grams of Heucophthal Blue G XBT 583D pigment, Heubach. Inc., Newark, N.J. were then dispersed in the polymer blend by two roll milling. Milling was at 120° C. for 25 minutes with cooling to 50° C. prior to removing the pigmented polymer blend from the rollers which was then chopped in a blender having a liquid nitrogen atmosphere. 40 grams of the chopped material 125 grams of Isopar ®-L, nonpolar liquid having a Kauri-butanol value of 27, Exxon Corporation and 125 grams of Isopar ®-H, nonpolar liquid having a Kauri-butanol value of 27. Exxon Corporation were placed in a Union process 01 Attritor, Union Process Company, Akron. Ohio. and milled at a rotor speed of 230 rpm with 0.1875 inch (4.76 mm) diameter stainless steel balls for 62 hours until toner particles having an average particle size of 0.93 μm were obtained. The particulate media were removed and the dispersion of toner particles was then diluted to 1 percent solids with additional Isopar ®-H and a charge director such as lecithin was added at an amount of 31 mg of lecithin/g of toner solids to give a bulk conductivity of 43 pmho/cm. Image quality was determined as described in Control 1.

Copy showed a density of 1.65 for plainwell offset enamel, with a resolution of 10–11 lp/mm, and a transfer efficiency of 100%. Compared to Control 1, this example shows improved resolution, evenness of toning transfer efficiency solid area coverage and good toning of fine details. Results are found in Table 1 below.

EXAMPLE 2

A cyan toner was prepared according to the procedure described in Example 1 with the following exceptions: 50 grams of poly(2-acrylamido-2-methyl-1-propane sulfonic acid) 10% aqeous solution (Aldrich Chemical Co.) were dispersed in 100 grams of the ethylene (89%)/methacrylic acid (11%) copolymer described in Example 1 by two roll milling at 120° C. 7.35 grams of the Heucophthal Blue G XBT 583D pigment were then dispersed by two roll milling at 120° C. for 37 minutes with cooling to 50° C. prior to removing the pigmented polymer blend from rollers. Cold attritor grinding was for 99.5 hours. Average particle size was 1.64 μm. The toner was diluted to 2% solids with Isopar ®-H and charged with 35 mg of lecithin/g of developer solids resulting in bulk conductivity of 54 pmho/cm.

Results show a density of 1.69 for plainwell offset enamel with a resolution of 6–8 lp/mm, and 94% transfer efficiency. Compared to Control 1, this example shows improved image quality with improved resolution, evenness of toning, solid area coverage, and toning of fine details. Results are found in Table 1 below.

EXAMPLE 3

A cyan toner was prepared according to the procedure described in Example 1 with the following exceptions: 20 grams of poly(styrene/2-acrylamido-2-methyl-1-propanesulfonic acid) (Aldrich Chemical Co.) were blended with 80 grams of the ethylene/methacrylic copolymer described in Example 1 by two roll milling at 130° C. 7.0 grams of the Heucophthal Blue G XBT 583D pigment were then dispersed by two roll milling. Milling was at 130° C. for 30 minutes with cooling to 80° C. prior to removing from the rollers. Cold attritor grinding was for 68 hours. Average particle size was 0.84 μm. Toner was diluted to 1.5% solids with Isopar ®-H.

Charging with lecithin at an amount of 40 mg of lecithin/g of developer solids resulted in a bulk conductivity of 44 pmho/cm. Results show a density of 1.61 for plainwell offset enamel, with a resolution of 10 lp/mm, and 97% transfer efficiency. Compared to Control 1, this example shows improved image quality with improved resolution. evenness of toning, solid area coverage, and toning of fine details. Results are found in Table 1 below.

EXAMPLE 4

A cyan toner was prepared according to the procedure described in Example 1 with the following exceptions: 50 grams of poly(2-acrylamido-2-methyl-1-propanesulfonic acid) 10% aqueous solution (Aldrich Chemical Co.) were dispersed in 100 grams of polystyrene (Ultrafine Powder, #15790) from Polysciences Inc.. Warrington, Pa. by two roll milling at 120° C. Only half of the poly(2-acrylamido-2-methyl-1-propanesulfonic acid) was incorporated into the polystyrene. 7.35 grams of the Heucophthal Blue G XBT 583D pigment were then dispersed by two roll milling. Milling was at 180° C. for 55 minutes. Cold attritor grinding was for 121 hours. Average particle size was 1.21 μm. Toner was diluted to 2% solids with Isopar ®-H.

Charging with lecithin at an amount of 35 mg of lecithin/g of developer solids resulted in bulk conductivity of 71 pmho/cm. Results show a density of 2.10 for plainwell offset enamel, with a resolution of 10–12 lp/mm, and 97% transfer efficiency. Compared to Control 2, this example shows improved image quality with improved resolution, evenness of toning, solid area coverage, and toning of fine details. Results are found in Table 1 below.

EXAMPLE 5

Toner was prepared as described in Control 5 except that the resin blend used was 20% copolymer of ethylene (89%) and methacrylic acid (11%), melt index at 190° C. is 100, Acid No, is 66, 20% polystyrene (Ultrafine powder, #15790) from Polysciences Inc., Warrington, Pa., and 60% poly(2-acrylamido-2-methyl-1-propanesulfonic acid) 10% aqueous solution (Aldrich Chemical Co.). The particle size measured was 1.62 μm. The image quality was very good with even solids and good resolution. The transfer efficiency was 60%. Results are shown in Table 1 below.

TABLE 1

| CONTROL (C) or Ex. (E) | COND. BULK (pmho/cm) | RESOLUTION (lp/mm) | SOLID AREA | IMAGE |
|---|---|---|---|---|
| C1 | 61 | 4–6 | V. Poor | V. Poor |
| C2 | 53 | 8–9 | Fair | Fair |
| C3 | 60 | 2–3 | V. Poor | V. Poor |
| C4 | 33 | 3–4 | Poor | Poor |
| E1 | 43 | 10–11 | Fair | Fair |
| E2 | 54 | 6–8 | Fair | Fair |
| E3 | 44 | 10 | Fair | Fair |
| E4 | 71 | 10–12 | V. Good | Good |
| E5 | 33 | 8–9 | V. Good | Good |

We claim:

1. A liquid electrostatic developer containing negatively chargeable resin particles with improved charging characteristics, said developer consisting essentially of (A) nonpolar liquid having a Kauri-butanol value of less than 30, present in a major amount;

(B) resin particles of a blend of at least two polymers, at least one polymer containing at least one acidic constituent having a pKa of less than 4.5 measured at 25° C. in water, and the blend having an acid number of at least one due to said acidic constituent; the resin particles having an average by area particle size of less than 10 μm, and (C) nonpolar liquid soluble ionic or zwitterionic charge director compound.

2. A liquid electrostatic developer according to claim 1 wherein the resin particles are substantially insoluble in nonpolar liquid (A) at temperatures below 40° C.

3. A liquid electrostatic developer according to claim 2 wherein the pKa of at least one acidic constituent is less than 3.0.

4. A liquid electrostatic developer according to claim 1 wherein the first polymer is poly(2-acrylamido-2-methyl-1-propane sulfonic acid).

5. A liquid electrostatic developer according to claim 1 wherein the first polymer is poly(styrene/2-acrylamido-2-methyl-1-propane sulfonic acid) (95%/5%).

6. A liquid electrostatic developer according to claim 4 wherein said second polymer is a copolymer of ethylene (89% by weight)/methacrylic acid (11% by weight) having a melt index of 100 at 190° C.

7. A liquid electrostatic developer according to claim 5 wherein said second polymer is a copolymer of ethylene (89% by weight)/methacrylic acid (11% by weight) having a melt index of 100 at 190° C.

8. A liquid electrostatic developer according to claim 4 wherein said second polymer is polystyrene.

9. A liquid electrostatic developer according to claim 5 wherein said second polymer is polystyrene.

10. A liquid electrostatic developer according to claim 1 wherein component (A) is present in 85.0 to 99.9% by weight component (B) is present in 0.1 to 15.0% by weight, based on the total weight of the developer, and component (C) is present in an amount of 1 to 1000 mg/g developer solids.

11. A liquid electrostatic developer according to claim 1 containing up to about 60% by weight of a colorant based on the weight of developer solids.

12. A liquid electrostatic developer according to claim 10 containinq up to about 60% by weight of a colorant based on the weight of developer solids.

13. A liquid electrostatic developer according to claim 11 wherein the colorant is a pigment.

14. A liquid electrostatic developer according to claim 13 whereln the percent pigment in the resin is 0.1% to 30% by weight based on the weight of developer solids.

15. A liquid electrostatic developer according to claim 11 wherein the colorant is a dye.

16. A liquid electrostatic developer according to claim 1 wherein the particles have an average by area particle size of less than 5 μm.

17. A liquid electrostatic developer according to claim 1 wherein component (C) is Basic Barium petronate.

18. A liquid electrostatic developer according to claim 1 wherein component (C) is lecithin.

19. A liquid electrostatic developer according to claim 1 wherein the resin particles comprise particles having a plurality of fibers extending therefrom.

20. A liquid eIectrostatlo deveIoper according to claim 1 wherein the resin particles are nonfibrous.

* * * * *